US005887293A

United States Patent [19]

Hennessy

[11] Patent Number: 5,887,293

[45] Date of Patent: Mar. 30, 1999

[54] SIMPLIFIED DUMP BUCKET TOILET

[76] Inventor: Arnold Hennessy, 64 West Street, Apt. 107, Wellington, Ontario, Canada, K0K 3L0

[21] Appl. No.: 14,633

[22] Filed: Jan. 28, 1998

[51] Int. Cl.[6] ..... E03D 1/20

[52] U.S. Cl. ..... 4/365

[58] Field of Search ..... 4/365

[56] References Cited

U.S. PATENT DOCUMENTS

| | | | |
|---|---|---|---|
| 536,150 | 3/1895 | Keller | 4/365 X |
| 577,021 | 2/1897 | Groszmann | 4/365 |
| 644,882 | 3/1900 | Wangelin | 4/365 |
| 1,182,957 | 5/1916 | Wright | 4/365 |
| 1,230,053 | 6/1917 | Stoffel | 4/365 |
| 1,428,971 | 9/1922 | Neumeyer | 4/365 |
| 2,212,943 | 8/1940 | Kolarik | 4/365 |
| 4,107,796 | 8/1978 | Nafziger | 4/365 X |

*Primary Examiner*—Robert M. Fetsuga
*Attorney, Agent, or Firm*—Freilich Hornbaker Rosen

[57] ABSTRACT

A dump bucket apparatus is described for use in a toilet of conventional shape and appearance, which is of simple construction and operation. The apparatus includes a bucket (50) that lies in a conventional tank (44) of long lateral (L) length and short front-to-rear depth, wherein the tank lies on the rear portion (40) of a toilet bowl part (20). Each end of the tank has a hole (122), and a bearing (124) extends through the hole and is fixed thereat to the tank. At least one end of the bucket is fixed to a trunnion (122) that extends through the bearing and that is fixed to a lever (64) lying immediately outside a tank end wall (100), with pivoting of the lever resulting in pivoting of the bucket. A deflector (82) lies at the bottom of the tank to one side of the water exit hole to minimize splashing and to concentrate water at the exit hole. At least one end (94) of the bucket is rounded into about a half circle as seen in a plan view, to provide room for a water inlet pipe (54).

14 Claims, 5 Drawing Sheets

SIMPLIFIED DUMP BUCKET TOILET

BACKGROUND OF THE INVENTION

A large majority of toilets in present use include a tank that can hold considerable water (e.g. five gallons) between flushings, and a flush valve at the bottom of the tank which is lifted to release water to the toilet bowl. Recent government regulations generally limit the amount of water used in each flushing to about 1.6 gallons. Although timed valves have been used to close the flush valve early and bricks have been placed in the tank to reduce the amount of water, such measures are easily reversed.

Applicant has been considering the development of a dump bucket toilet, which is described in several old patents, but which applicant has not seen in use. In such toilets, a bucket holds water between flushings and is tipped to release substantially all water. Applicant's recent U.S. Pat. No. 5,666,674 shows one design that applicant earlier developed. Applicant realizes that despite the advantages of a dump bucket toilet, of accurately measuring flush volume, permanently limiting the amount of water dispensed in each flushing, and avoiding leakage from leaky flush valves, that such toilets will not replace modified conventional toilets unless the new dump bucket toilet is of great simplicity and operates to provide an effective flushing with little water, in a tank of conventional shape and moderate height. Such a conventional tank usually lies very close to a bathroom wall, with the toilet bowl part extending forwardly therefrom. The shape and size of the toilet bowl part is substantially fixed, and to assure that it projects as little as possible forward of the bathroom wall, the tank must have a small forward-to-rearward depth of less than one foot. A dump bucket toilet which fit into a tank of such conventional shape, and which was of great simplicity and of reliable and efficient construction, would be of value.

SUMMARY OF THE INVENTION

In accordance with one embodiment of the present invention, a dump bucket is provided which lies in a tank of conventional shape and usually of relatively low height, and which is of very simple design but effective in operation. The toilet includes a tank having a small front-to-rear longitudinal depth B and a much greater lateral length, to extend a small distance forward of a bathroom wall. A bucket which is pivotally mounted within the tank, has a long lateral length and much shorter longitudinal depth. At least one lateral end of the tank is connected through a trunnion to a lever lying immediately outside a corresponding end wall of the tank. Pivoting of the lever in one direction, causes pivoting of the bucket to release water into the tank to flow through the water tunnel to the bowl.

The bucket is allowed to pivot from an upright position wherein its top lies in a horizontal plane, to a release position wherein its top has pivoted about 95° to a primarily vertical orientation. The pivoting is preferably towards the rear of the tank, although it could be toward the front. A deflector lies near the bottom of the tank at a location generally forward of the water exit hole at the bottom of the tank, to reduce splashing of water and to help direct water into the water exit hole. The bucket is preferably a molded plastic part, with its opposite ends preferably being curved to form largely a half circle at each end, with a half circle at one end providing clearance for an upstanding water inlet pipe for the inlet valve. One end of the tank is molded with a coupling for rigid connection to a trunnion that extends through a bearing to the lever. The bearing extends through a hole in an end wall of the tank.

The novel features of the invention are set forth with particularity in the appended claims. The invention will be best understood from the following description when read in conjunction with the accompanying drawings.

DESCRIPTION OF THE PREFERRED EMBODIMENTS

Figure 1:
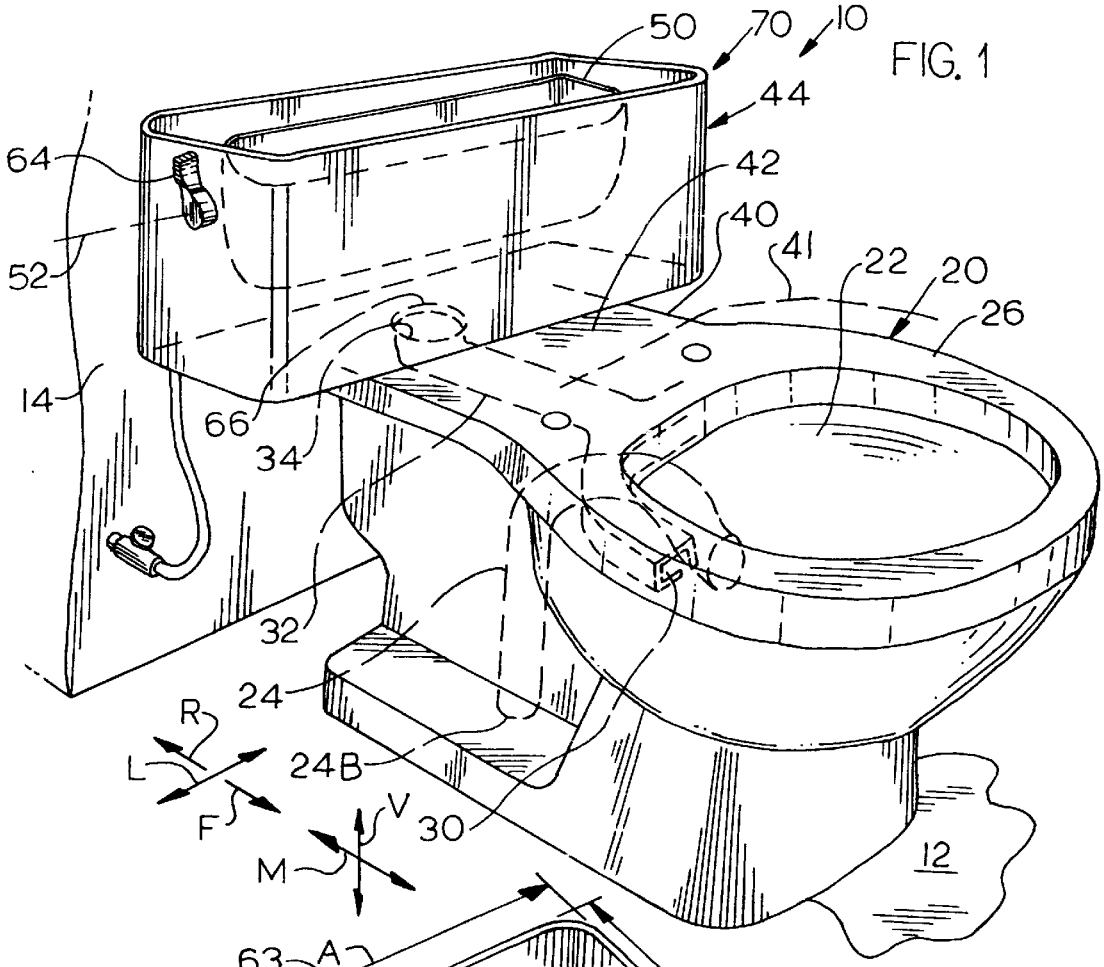
FIG. 1 is a perspective view of a toilet shown installed in a bathroom and extending forward from a bathroom wall.

FIG. 1 illustrates a toilet 10 installed on the floor 12 of a bathroom, and lying forward F of a vertical bathroom wall 14. The toilet includes a toilet bowl part 20 with a bowl 22 for holding water and waste and a bowl outlet 24. A rim 26 that encircles the bowl, includes a rim conduit 30 that carries water and dispenses it through holes into the bowl. The rim conduit connects to a water tunnel 32 that has an entrance or tunnel hole 34. A rear portion 40 of the toilet bowl part has an upper surface 42 that supports a tank 44. The tank 44 is of conventional largely parallelepiped shape, with a depth in forward-rearward directions F, R, which are longitudinal directions M, generally being less than one foot and preferably less than ten inches, with the particular depth B (FIG. 2) of the embodiment of FIGS. 1–8 being 8¾ inch. The tank has a length A in the lateral direction L, which is more than 50% greater than its depth, with the particular lateral length A being 18¾ inch, which is at least twice as great as B. In the particular tank illustrated, that applicant has designed, the tank walls are ½ inch thick and the tank height is 8½ inches, with an extra ¾ inch for the cover. The toilet is usually installed by a plumber who places the bottom 24B of the bowl outlet in alignment with a drain on the bathroom floor. The tank 44 then lies close to the bathroom vertical wall 14. When a toilet seat 40 is tilted up, it extends at a rearward-upward incline of about 20° and is stopped by the tank cover which covers the top of the tank.

Figure 2:
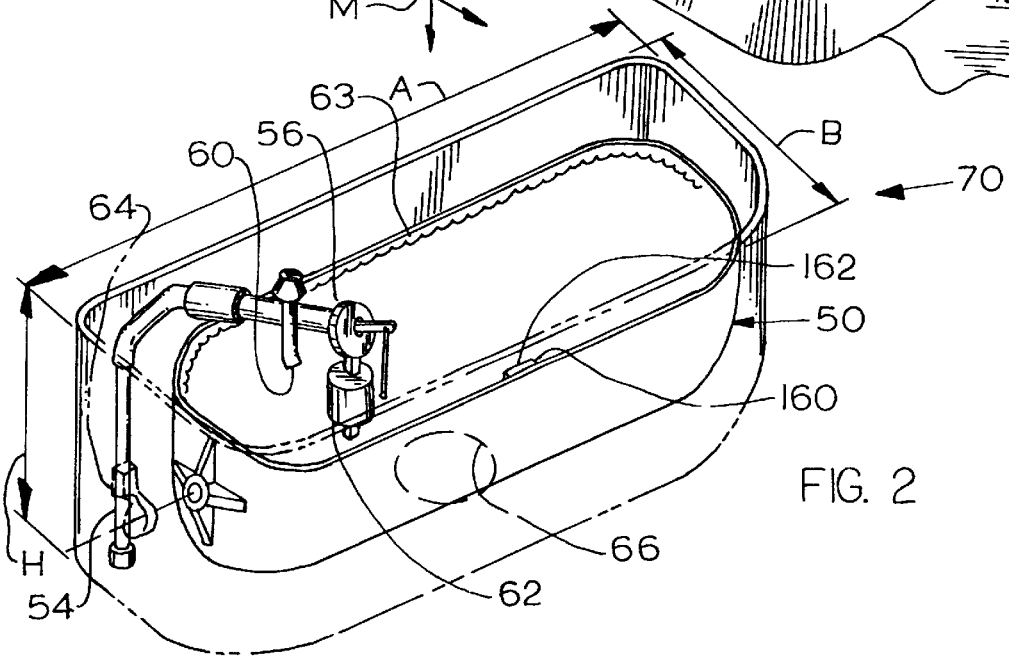
FIG. 2 is a top and front isometric view of the tank and dump bucket of FIG. 1, with the front portion and one side portion of the tank being shown in phantom lines.

The particular toilet is a dump bucket toilet, which includes a bucket 50 that lies within the tank and that is pivotally mounted about a lateral axis 52 therein. As shown in FIG. 2, water passes up through a pipe 54 to an inlet valve 56 that has an outlet 60 that directs water into the bucket. A float 62 stops the rise of water when the water level 63 is very close to the top of the bucket, such as one-quarter inch from it. When the handle or lever 64 is moved towards the rear, the bucket tips, and tends to continue tipping, until the bucket has tilted about 95° (±10°) from its initial upright position. Water in the bucket is dumped into the bottom of the tank and exits the tank through a water exit hole 66.

Figure 5:
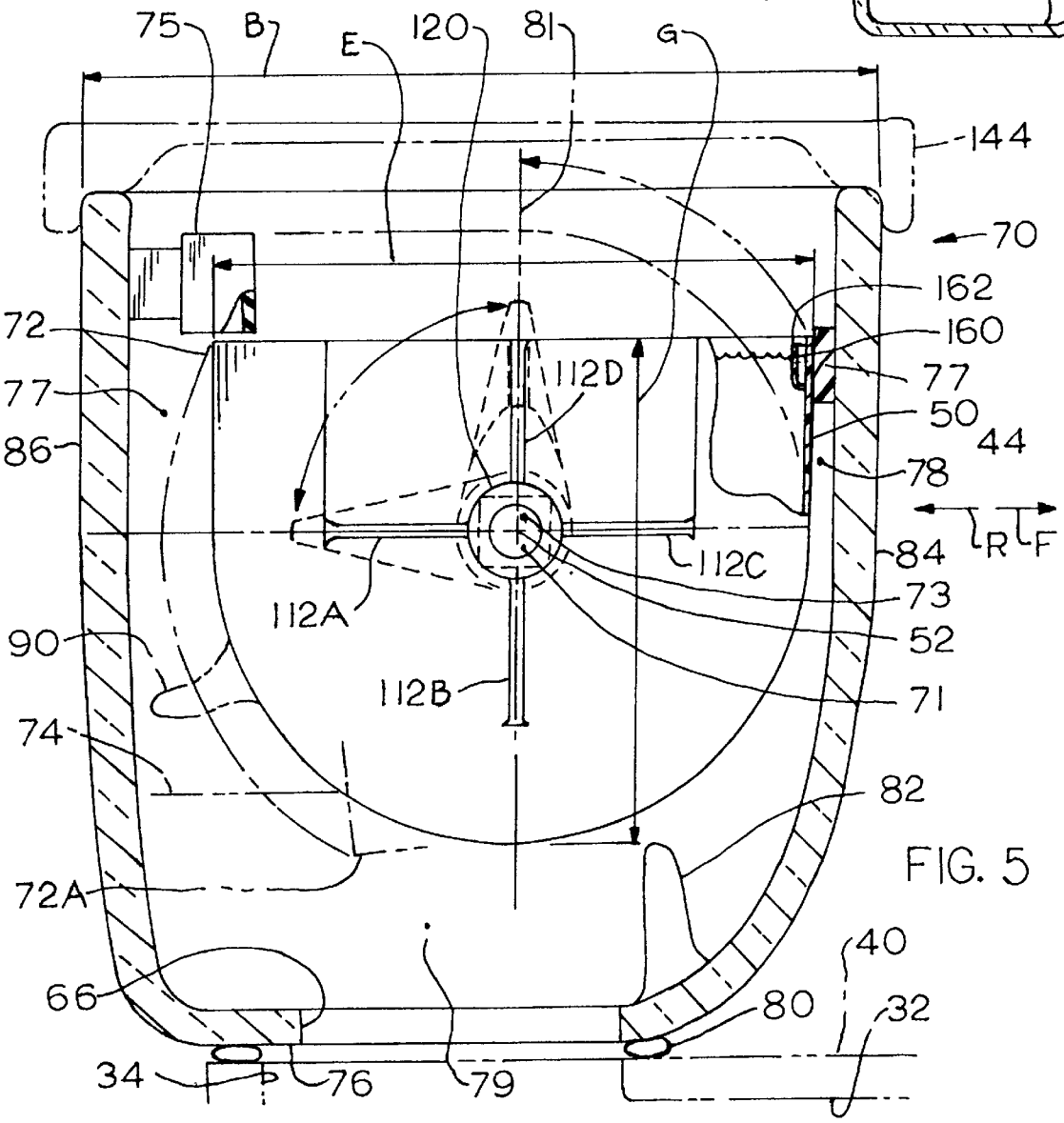
FIG. 5 is a sectional end view of the apparatus of FIG. 3.

FIG. 5 illustrates some details of the dump bucket apparatus 70 which includes the bucket 50 and the tank 44. The bucket has a depth E which is only slightly greater than its height G, with the particular bucket shown having a depth E of 6½ inch and a height G of 5¼ inch. The bucket length Q (FIG. 3) is 15⅜ inch. The center of gravity of the bucket is above the axis 52 when filled, but below the axis 52 when empty, so the bucket automatically returns to the upright position after tipping. Point 71 is the center of gravity of the empty bucket while point 73 is the center of gravity of the filled bucket. A stop 77 such as a rubber plate of selected thickness, holds the bucket in position when filled. Another stop 75, such as a section of rubber hose, is also shown, as the stop can be in any location. When the bucket is tilted, its upper rear corner 72 pivots about the axis 52 to the dump position 72A. Substantially all of the water in the bucket is dumped into the lower portion of the tank, to a level such as indicated at 74. However, as the bucket is tilted and before it begins to right itself, water quickly passes out of the water exit hole 66 in the bottom wall or bottom 76 of the tank and into the water tunnel 32. It can be seen that a gasket 80 lies between the tank bottom 76 and the toilet bowl rear portion 40 to seal the fluid connection to the entrance 34 to the water tunnel 32. There are gaps 77, 78 between the bucket and tank, with the gap 77 between the rear walls of the bucket and tank being larger. A gap 79 under the bucket is preferably at least about 40% of the volume in the bucket, to allow the bucket to immediately tilt up after dumping its water, without scooping up appreciable water. The gap 79 is preferably no more than about 80% of the volume to enable a low tank to be used. A vertical centerplane 81 that passes through the pivot axis, lies closer to the front wall 84 than the rear one, when the bucket is constructed to tip rearward.

Applicant provides a deflector 82 at the bottom of the tank, at one side of the water exit hole 66. The deflector 82 reduces splashing of the suddenly dumped water along the front wall 84, as the water is dumped against the rear wall 86 and into the bottom of the tank. In addition, the deflector 82 tends to concentrate the dumped water in the area immediately above the water exit hole 66 for faster exit of the water. A rapid passage of water into and along the water tunnel and into the toilet bowl, results in a better flushing wherein more of the debris in the toilet bowl is flushed out. Although the deflector 82 is shown mounted on the tank, it is also possible to provide a deflector at 90 on the bucket, to serve the same purpose.

Figure 3:
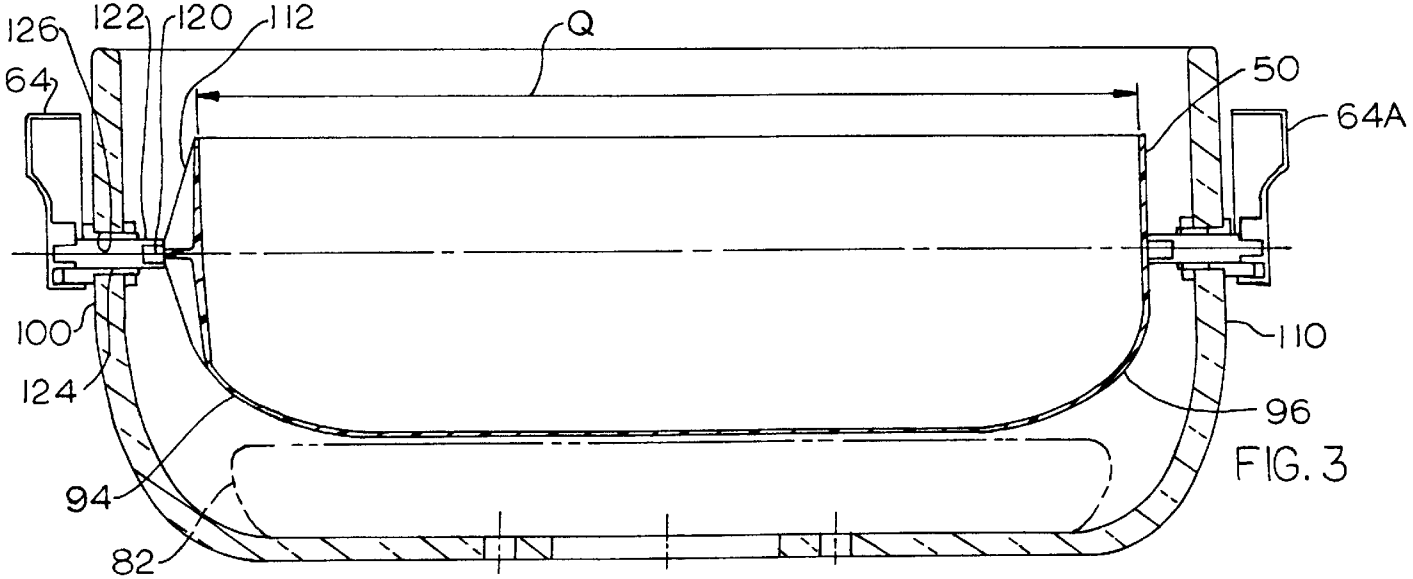
FIG. 3 is a sectional front view of the apparatus of FIG. 2.
Figure 4:
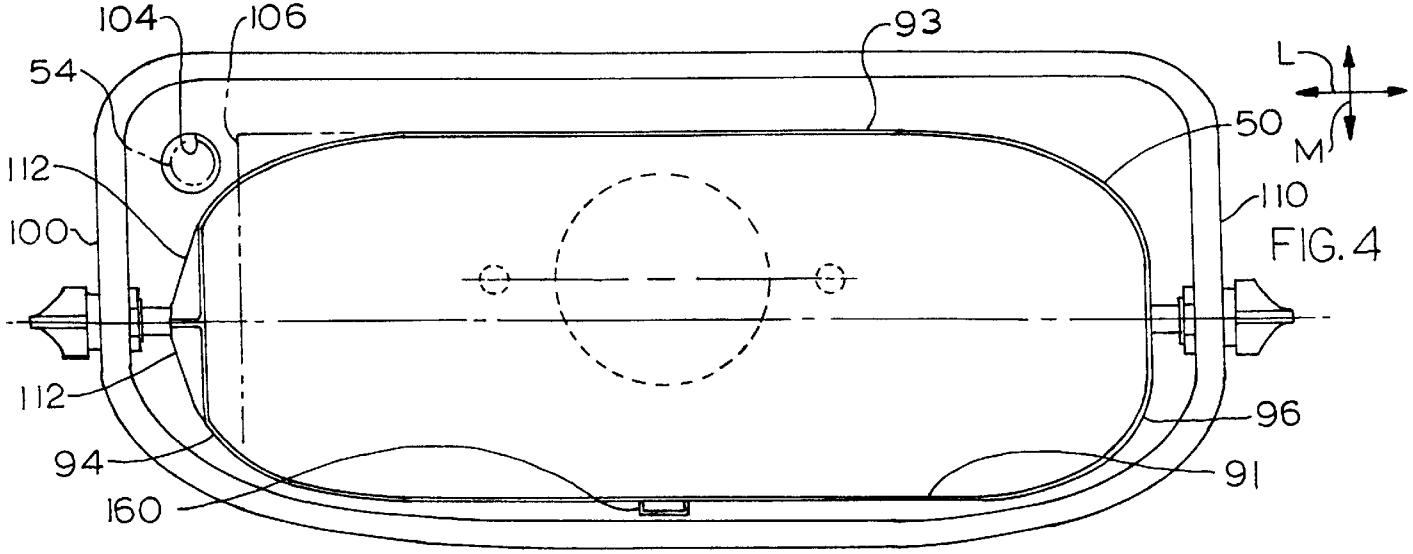
FIG. 4 is a plan view of the apparatus of FIG. 3.

FIGS. 3 and 4 show the shape of the bucket 50. Although front and rear walls 91, 93 of the bucket extend laterally along most of their length, the end portions 94, 96 of the bucket are rounded to a largely semicircular shape as seen in a plan view. The largely circular shape as at 94 near a first tank end wall 100 provides clearance for the inlet pipe 54 which connects through a fitting extending through a hole 104 in the bottom of the tank. It otherwise would be possible to form the bucket with a straight end as indicated at 106. However, such a straight end would result in a loss of volume of the bucket at its end, and also result in sharper edges which reduce the ruggedness of the preferably plastic molded dump bucket. Applicant prefers to provide a largely half circle at the other end 96 of the bucket which lies close to the opposite tank end wall 110 for a largely symmetric appearance.

It may be noted that the first end portion 94 of the bucket has ribs 112. As shown in FIG. 5, there are four strengthening ribs 112A–112D that extend to a trunnion coupling 120 at the first end of the bucket. These ribs preferably lie on the outside of the bucket, but could lie in the inside. FIG. 3 shows that the trunnion coupling 120 is fixed to a trunnion 122 that is, in turn, fixed to the lever 64. A pivot bearing 124 extends through a hole 126 in the first tank end wall 100 and is fixed in position therein, with the trunnion extending through the bearing and being pivotally mounted thereon. The opposite end of the bucket is similar, except that it does not have ribs that serve to space the bucket first end from the tank end wall 100 to leave room for an upstanding water pipe, since the water pipe lies only at the left end of the tank. Otherwise, the mounting of the tank end portion 96 is the same. It is possible to mount the second end of the bucket on a bearing that does not project from the second tank wall.

Figure 6:
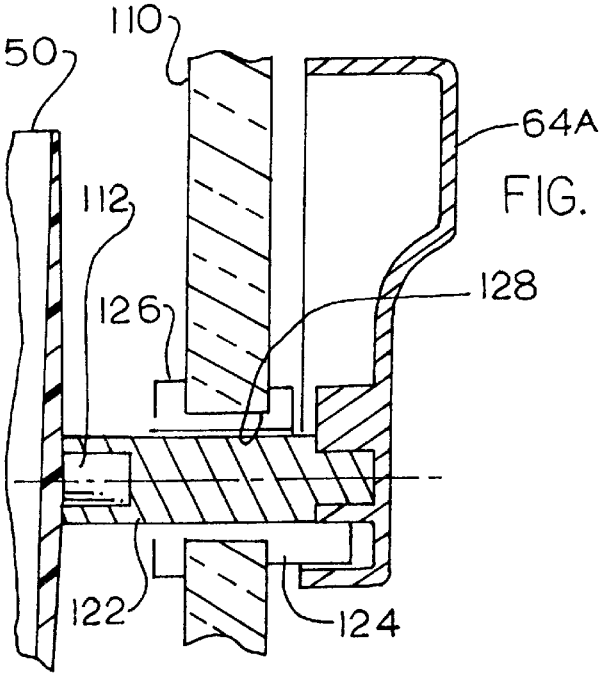
FIG. 6 is a sectional side view of one end of the bucket and the tank, showing a lever and coupling apparatus thereof.
Figure 7:
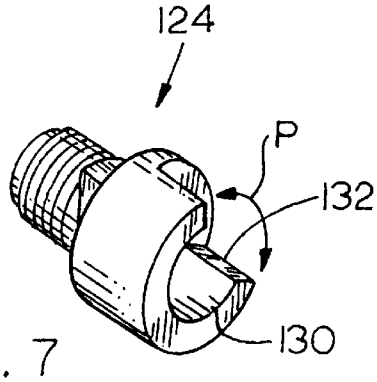
FIG. 7 is an isometric view of the bearing of the apparatus of FIG. 6.

FIG. 6 shows details of the mounting of the bucket 50 on a tank end wall 110. The trunnion coupling 112 is molded as a part of the bucket. The trunnion 122 is fixed to the trunnion coupling 112 as by a press-fit therewith. Of course, it is possible to form a larger trunnion coupling with a hole, so the trunnion can fit into the hole instead of surrounding the coupling. The bearing 124 extends through a hole 128 in the tank wall 110, and the bearing is held in place by a nut 126. As shown in FIG. 7, the bearing 124 has a hole 130 that receives the trunnion. The bearing outer end has a gap 132, that allows the lever 64A to pivot by an angle P of about 95°. Although it is possible to provide a lever only at one end of the toilet, applicant prefers to provide levers at opposite ends, since the additional cost is very small and it adds to convenience in operation of the toilet.

There are other options for location and operation of the flush handle mechanism. One option is to use a pivotally mounted handle projecting from the front of the tank which is connected through a lever and chain connection to the bucket. Another option is a spring loaded push button incorporated into the lid of the ceramic tank. When such push button is depressed its bottom pushes on the rear of the bucket (for a rear-tilt bucket) to tilt the bucket past its tipping point. Applicant prefers the illustrated direct connection for its simplicity and reliability.

Figure 8:
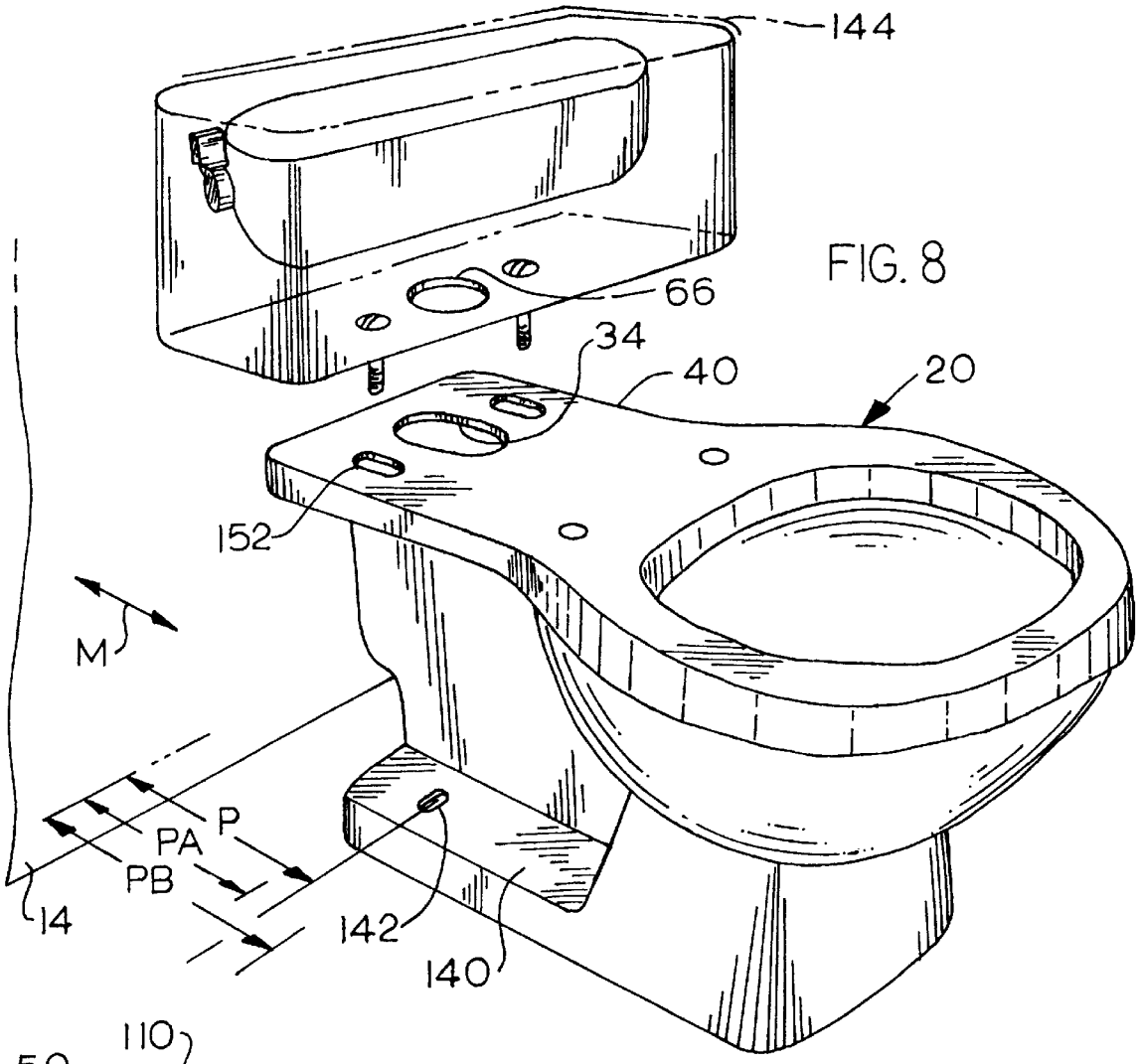
FIG. 8 is an exploded view of the toilet of FIG. 1, showing the elongated entrance to the water tunnel and elongated fastener receiving holes in the toilet part of the toilet of FIG. 1.

FIG. 8 shows that while the 3¾ inch water exit hole 66 is round, the entrance or entrance hole 34 to the water tunnel 32 is elongated in a longitudinal direction M. The bottom portion of the toilet bowl part 20 has mounting flanges 140 with holes 142 that are normally a distance P of twelve inches from the finished bathroom wall 14. In that case, the back of the cover 144 on the tank may lie less than one inch from the bathroom wall. However, if the distance P is slightly less as at PA which is a distance of eleven inches, then the tank cover 150 may hit the wall, while at the distance at PB is too great, such as thirteen inches, and space will be wasted by a large gap between the cover and the wall. To facilitate toilet installation, applicant constructs the tunnel hole or entrance 34 so it is elongated in the longitudinal direction M by two inches. Usually, the round exit hole 66 will lie halfway between the front and rear ends of the hole 34, but if there is a mistake in the placement of the drain, then the tank can be moved slightly forward or rearward to just clear the wall 14 (e.g. lie a small distance such as three-quarters inch away). With the tunnel hole 34 longer in a longitudinal direction by at least one inch, than the tank water exit hole, water will always move rapidly out of the tank. The rear portion 40 of the toilet bowl part also has a pair of elongated fastener receiving holes 152 that permit such movement of the tank. The elongated holes could instead be placed in the bottom of the tank instead of the toilet bowl rear portion 40, although applicant prefers to place them in the toilet bowl part rear portion. As shown in FIG. 5, a gasket 80 is placed around the tunnel entrance.

In ordinary toilets, there is a possibility of leakage if the float of the toilet inlet valve is set too high so that water trickles through an overflow tube into the toilet bowl. In the present dump bucket toilet such high setting of the float 62 in FIG. 2 could result in water leaking over the top of the bucket and into the toilet tank. It is often difficult for a person looking at the bucket to determine whether there is leakage. Applicant provides a container 160 that is connected to the inside of the bucket 50 and that has an entrance 162 that lies about one-tenth inch below the top of the bucket. If a person takes off the tank cover and looks at the container 160, then if he sees any water in the container this will indicate that the float is set too high or the fill valve is leaking, so there is probably a repeated spillover of water. The container 160 is emptied in every flushing, so the presence of any water indicates that an adjustment is required. The leakage detection container may be placed in various locations around the rim of the bucket, and may lie inside or outside the tank. A pair of containers 160 can be provided, one at the front of the bucket the other at the rear, to detect leakage caused by the top of the bucket not being horizontal in its filled position.

Figure 9:
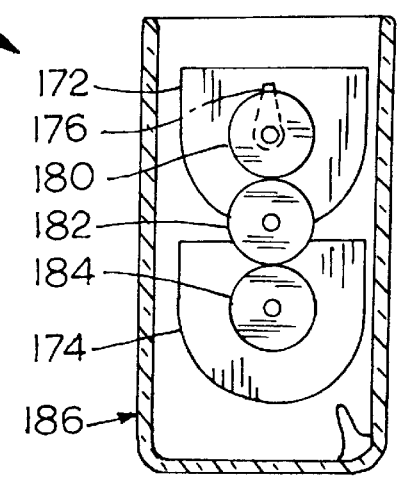
FIG. 9 is a sectional view of a dump bucket toilet constructed in accordance with another embodiment of the invention.

FIG. 9 illustrates another dump bucket apparatus 170 that includes two buckets 172, 174. A handle 176 lies on the axis of the upper bucket. Gears 180, 182, 184 connect the buckets so they tip together. The tank 186 has a small front-to-rear depth.

Figure 10:
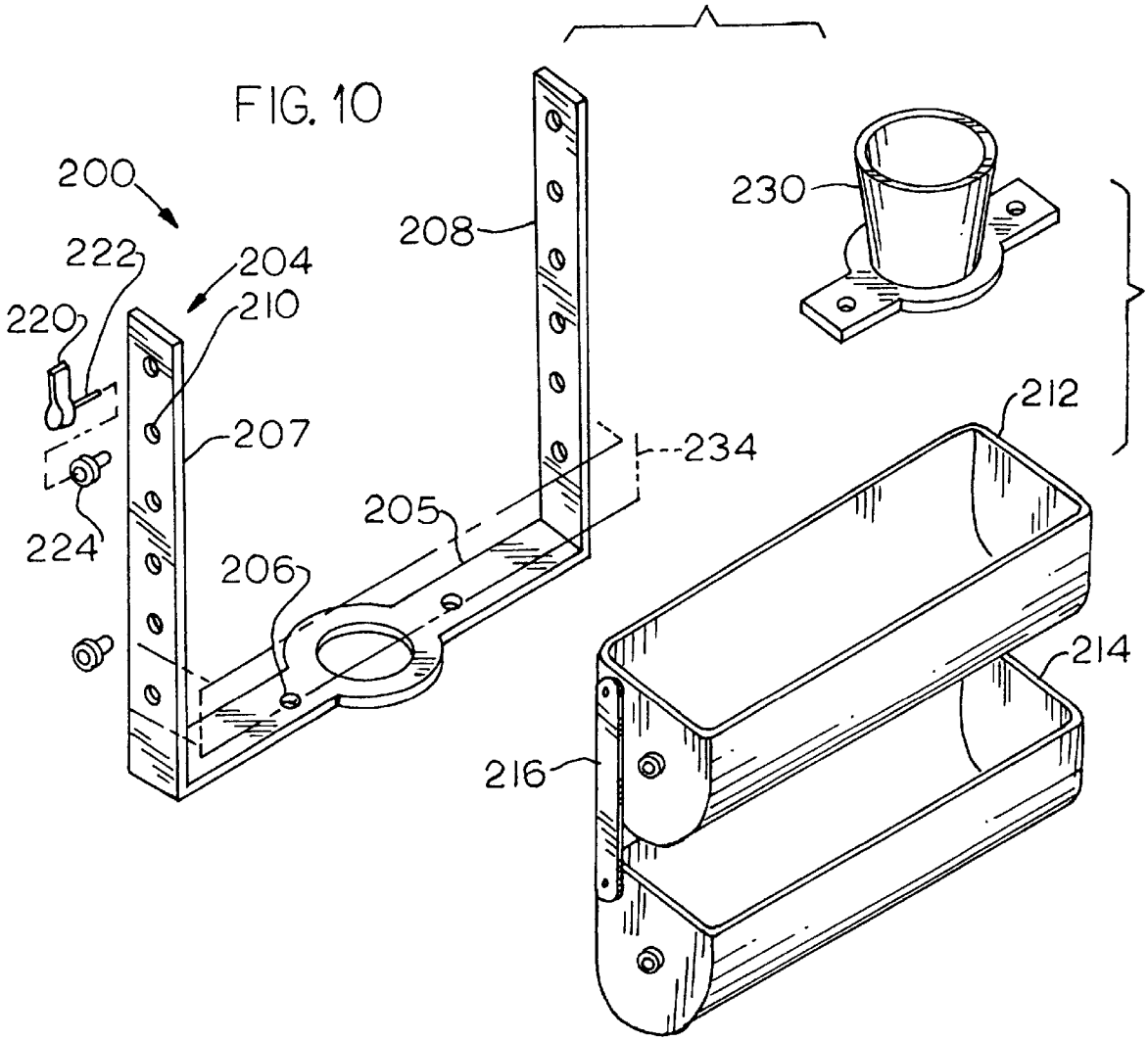
FIG. 10 is an exploded isometric view of apparatus of another embodiment of the invention for use in a toilet tank.
Figure 12:
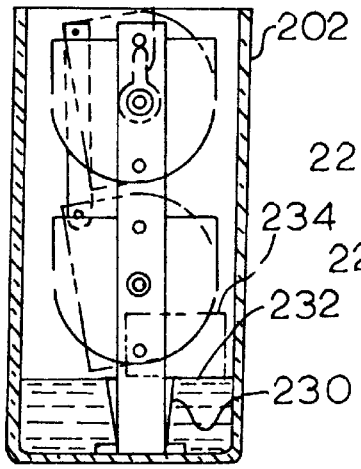
FIG. 12 is a view taken on line 12—12 of FIG. 11.
Figure 11:
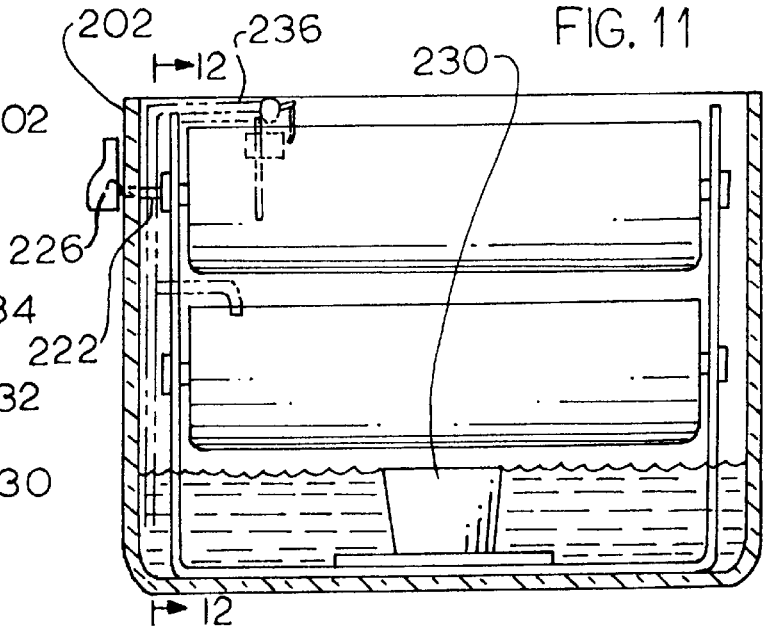
FIG. 11 is a sectional front view of the apparatus of FIG. 10 mounted in a toilet tank.

FIGS. 10–12 illustrate another dump bucket apparatus 200 suitable as a retrofit kit for installing in an existing two-piece toilet tank 202. The flush valve and other parts are removed. The apparatus includes a mounting bracket 204 with a bottom part 205 that is attached to the tank through holes 206 that are aligned with existing mount holes. The bracket has vertically extending ends 207, 208 with sets of holes 206. The bracket has vertically extending ends 207, 208 with sets of holes 210 for mounting one bucket or two or more vertically tandem buckets, with two buckets 212, 214 being shown. A link 216 is pivotally joined to adjacent ends of the buckets at the front or rear, depending on the tilt direction of the buckets. A handle 220 is fixed to a shaft 222 extending from the handle through a bushing 224 mounted on the mounting bracket to one of the buckets. When the handle is pivoted, both buckets tilt and dump water. FIG. 11 shows that the shaft 222 extends through a hole 226 in the tank. Although the tank hole 226 is preferably sealed around the shaft, no water will leak out in any case.

A funnel 230 is provided, whose top lies closely below the lowest bucket. As shown in FIG. 12, water remains in the tank between flushings, at a level 232 equal to the top of the funnel. A deflector 234 can be mounted on the bracket. A fill valve 236 (FIG. 11) has its output equally divided between the two buckets, with a float lying in only one of the buckets to stop the refill when the buckets are full.

Thus, the invention provides a dump bucket toilet apparatus that fits in a tank of conventional shape, wherein the lateral width of the tank is at least 150% and preferably at least 200% of the longitudinal depth of the tank, wherein the toilet is of simple and reliable design. The dump bucket mechanism will fit into a two-piece toilet as well as a one-piece toilet, with little or no modification. A lever lying outside a first tank end and connected to the bucket, can be moved to tilt the bucket and cause a toilet bowl flushing. A bearing extends through a hole in the first tank wall and a trunnion extends through the bearing, with an inner end of the trunnion fixed to the bucket and an outer end of the trunnion fixed to the lever. A deflector can be placed so it lies at the bottom of the tank when the bucket is tilted, on a side of the outlet opposite the leading top edge of the bucket to minimize splashing and to concentrate water to rapidly flow out through the water exit hole. With a water inlet pipe extending at a first end of the tank near its rear, the first end of the bucket is curved into a largely half circle, as seen in a plan view, to provide extra volume while smoothly passing within the area occupied by the water inlet pipe. The first end of the molded bucket preferably has ribs that extend to a trunnion coupling, to take up the extra space at the first end.

Although particular embodiments of the invention have been described and illustrated herein, it is recognized that modifications and variations may readily occur to those skilled in the art, and consequently, it is intended that the claims be interpreted to cover such modifications and equivalents.

What is claimed is:

1. A dump bucket toilet apparatus comprising:

a tank which has a lateral length (A), a front-to-rear-longitudinal depth (B), and a vertical height (H);

a bucket which lies in said tank, said bucket having a lateral width, longitudinal depth, and vertical height, with said lateral width being at least about twice said longitudinal depth;

an inlet valve coupled to said bucket to fill it with water;

said tank having laterally-spaced end walls, and including pivot bearings on each of said end walls;

a pair of trunnion portions each fixed to said bucket and pivotally mounted about a lateral pivot axis on one of said bearings, to allow the bucket to tilt to dump water into the tank;

a lever lying outside said tank at a first of said tank ends and connected to said bucket, so tilting of said lever causes turning of said trunnion portions and tilting of said bucket to dump water into said tank;

said lateral tank length (A) is at least 150% of the longitudinal tank depth (B), to allow all of the tank to fit close to a bathroom wall, and said lever lies at a first of said tank end walls.

2. The apparatus described in claim 1 wherein:

said bucket is positioned with front and rear gaps between it and said tank and a bottom gap between it and said tank;

said tank is of largely rectangular cross-section as viewed along said lateral pivot-axis and includes a primary horizontal bottom and primarily vertical front and rear walls, with said bottom gap being larger than the average of said front end rear gaps;

said bucket is mounted to pivot from an initial position wherein it holds water, to a dump position wherein it releases water; and including a deflector lying in said tank below said pivot axis and to one side of a vertical centerplane that extends through said pivot axis, with said deflector constructed to reduce the splashing of water up a corresponding one of said longitudinally-spaced end walls of said tank.

3. The apparatus described in claim 1 wherein:

said dump bucket has laterally opposite ends, with at least a first of said ends being largely in the shape of a half circle as seen in a plan view when said bucket is upright.

4. The apparatus described in claim 1 wherein:

said bucket is a molded part which has laterally opposite bucket ends with a first of said ends having a molded-in trunnion coupling;

a first of said tank end walls has a tank wall hole therein lying along said lateral pivot axis;

a bearing extending completely through said first tank wall hole and mounted thereon said tank;

a trunnion extending through said bearing and having an inner end fixed to said trunnion coupling and having an outer end fixed to said lever.

5. The apparatus described in claim 4:

said molded-in trunnion coupling comprises a laterally protruding shaft, and said trunnion inner end fits closely around said shaft.

6. The apparatus described in claim 4 wherein:

each of said tank end walls has a wall aperture, and each of said opposite bucket ends has a trunnion coupling;

said molded plastic bucket has an inner surface, with the bucket inner surface at said bucket first end being spaced from said tank first end by more than the spacing of said bucket inner surface at an opposite second end of said bucket from a second end of said tank, and with the outside of said bucket first side including a lateral extension that forms a trunnion coupling.

7. The apparatus described in claim 1 including:

a leak-indicating container coupled to substantially the top of said bucket.

8. A toilet for installation in a bathroom in front of a bathroom wall, comprising:

a toilet which includes a toilet bowl part that has a rim for supporting a seat and that forms a rim conduit and that has walls forming a toilet bowl and a toilet bowl outlet, said toilet including a tank with a bottom having an exit hole and with laterally opposite ends, and said toilet bowl part forms a water tunnel connecting said exit hole to said rim conduit, wherein said tank lies rearward and above the level of the toilet bowl, to enable a person to sit on the seat and face away from the tank and bathroom wall, with the housing extending a minimum longitudinal distance forward of the bathroom wall;

said tank has a lateral length (A) which is at least 50% greater than its depth (B) in a longitudinal direction;

a bucket which lies in said tank and which has a lateral length and longitudinal depth, said bucket being pivotally mounted about a lateral pivot axis in said tank;

a handle lying outside said tank at one side thereof and connected to said bucket to pivot it about said pivot axis.

9. The toilet described in claim 8 wherein:

said water tunnel has a rear end that extends down from said exit hole and has a major portion that extends horizontally and forwardly from said rear end to said rim conduit;

said bucket has an initial rotational position about said pivot axis when said bucket is stationary and most of its volume is filled with water, and including means for allowing bucket tilt in only a first direction so its upper end moves in a first longitudinal direction;

said water exit hole is longitudinally offset, in a second direction which is opposite said first direction, from a location directly under said pivot axis, to direct some water spilled from said bucket directly into said water exit hole for movement along said water tunnel to said rim conduit.

10. The toilet described in claim 8 wherein:

said bucket has upper and lower parts that respectively lie above and below said pivot axis in a quiescent position of said bucket, with the center of gravity of said bucket when filled with water lying slightly under said pivot axis, and with the center of gravity of said bucket when empty also lying under said pivot axis in said quiescent position;

the volume under said bucket and above said tank bottom wall, is at least 40% of the volume of said bucket, so said bucket can pivot back toward said quiescent condition immediately after it tilts about 90° therefrom with over 90% of the water flushed through the water exit hole.

11. The toilet described in claim 8 wherein:

said toilet bowl part and said tank are separately molded parts, wherein said toilet bowl part has a rear portion with an upper support surface and a tunnel water hole in said upper surface, a toilet bowl, and a rim having a rim conduit extending about and opening to said bowl portion, and a water tunnel extending generally forwardly from said tunnel water hole to said rim conduit;

said tank bottom rests on said support surface and is fastened to said rear portion of said toilet bowl part;

said tank bottom has an exit water hole that opens to said tunnel water hole, with one of said water holes being elongated in a longitudinal direction by more than the other, to thereby enable longitudinal adjustment of the tank on the support surface.

12. The apparatus described in claim 8 wherein:

said handle comprises two handles, each lying outside a different one of said tank side walls and connected to a corresponding end of said bucket.

13. A dump bucket toilet apparatus comprising:

at least two buckets that each holds water and that each can be tilted to release the water;

means for pivotally supporting said buckets in a toilet tank with one bucket lying above the other, and for coupling said buckets so they tilt in unison.

14. The apparatus described in claim 13 wherein:

said means for pivotally supporting said buckets includes a bracket with a bottom part for mounting on a toilet tank and with laterally opposite bracket ends extending upwardly from said bottom part, with said buckets each pivotally mounted on said bracket ends.

* * * * *